United States Patent [19]

Russell et al.

[11] Patent Number: 4,675,852

[45] Date of Patent: Jun. 23, 1987

[54] APPARATUS FOR SIGNALLING WITHIN A BOREHOLE WHILE DRILLING

[75] Inventors: Michael K. Russell; Anthony W. Russell, both of Cheltenham, England

[73] Assignee: NL Industries, Inc., Houston, Tex.

[21] Appl. No.: 671,342

[22] Filed: Nov. 14, 1984

[30] Foreign Application Priority Data

Nov. 22, 1983 [GB] United Kingdom ..... 8331111

[51] Int. Cl.[4] ..... G01V 1/40; E21B 47/12

[52] U.S. Cl. ..... 367/84; 367/83; 181/106; 33/307

[58] Field of Search ..... 367/83, 84, 911, 912; 181/106; 166/113; 175/40, 48; 33/307

[56] References Cited

U.S. PATENT DOCUMENTS

| | | | |
|---|---|---|---|
| Re. 29,734 | 8/1978 | Manning | 367/83 |
| Re. 30,055 | 7/1979 | Claycamb | 367/84 |
| Re. 30,246 | 4/1980 | Richter et al. | 367/83 |
| 3,792,429 | 2/1974 | Patton et al. | 367/84 |
| 3,982,224 | 9/1976 | Patton | 367/84 |
| 3,997,867 | 12/1976 | Claycomb | 367/83 |
| 4,167,000 | 9/1979 | Bernard et al. | 367/84 |

FOREIGN PATENT DOCUMENTS

| | | | |
|---|---|---|---|
| 0197806 | 6/1978 | Canada | 367/84 |
| 2087951 | 3/1982 | United Kingdom . | |
| 2082653 | 3/1982 | United Kingdom . | |

OTHER PUBLICATIONS

Patton et al., Development and Successful Testing of a Continuous-Wave . . . ", 10/77, Jour. Petr. Tech., pp. 1215-1221.

*Primary Examiner*—Nelson Moskowitz
*Attorney, Agent, or Firm*—Douglas H. May

[57] ABSTRACT

A down-hole signal generator for a mud-pulse telemetry system comprises an annular impeller surrounding a casing and arranged to be driven by the mud passing along the drill string. The impeller serves to drive a torque control arrangement, and preferably also an electrical generator, within the casing. The torque control arrangement is switchable between two states by a signalling actuator in response to an electrical input signal. In a first state the impeller may be driven relatively easily so that it is rotated at a relatively fast speed by the mud flow, whereas, in a second state, a greater torque is required to drive the impeller so that it is rotated at a relatively slow speed. Thus suitable variation of the input signal may be used to vary the impeller speed to transmit a modulated pressure signal in the mud flow which may be sensed at the surface.

8 Claims, 2 Drawing Figures

APPARATUS FOR SIGNALLING WITHIN A BOREHOLE WHILE DRILLING

BACKGROUND OF THE INVENTION

This invention relates to apparatus for signalling within a borehole while drilling, and is more particularly concerned with a down-hole signal transmitter for a mud-pulse telemetry system.

Various types of measurements-while-drilling (MWD) systems have been proposed for taking measurements within a borehole while drilling is in progress and for transmitting the measurement data to the surface. However to date only one type of system has enjoyed commercial success, that is the so-called mud-pulse telemetry system. In that system the mud stream, which passes down the drill string to the drill bit and then back up the annular space between the drill string and the bore wall with the object of lubricating the drill string and carrying away the drilling products, is used to transmit the measurement data from a down-hole measuring instrument to a receiver and data processor at the surface. This is achieved by modulating the mud pressure in the vicinity of the measuring instrument under control of the electrical output signal from the measuring instrument, and sensing the resultant mud pulses at the surface by means of a pressure tranducer.

The applicants' British Patent Specifications Nos. 2,082,653A and 2,087,951 disclose such a system in which a flow constrictor defines a throttle orifice for the mud passing along the drill string, and a throttling member is displaceable under control of the electrical output signal from the measuring instrument to vary the throughflow cross-section of the throttle orifice and to thereby modulate the mud pressure. The system includes a turbogenerator driven by the mud flow for supplying electrical power to the measuring instrument.

It is an object of the invention to provide a generally improved down-hole signal transmitter which is particularly compact and well adapted to operation down-hole in a hostile environment.

SUMMARY OF THE INVENTION

According to the invention there is provided a down-hole signal transmitter for a mud-pulse telemetry system, comprising an impeller rotatable in the mud flow passing along a drill string when the transmitter is installed down-hole in use, torque control means coupled to the impeller to vary the torque required to drive the impeller such that, in a given mud flow, the impeller is driven by the mud flow at a first rotational speed when the control means is in a first state and at a second rotational speed when the control means is in a second state, and signalling means coupled to the torque control means and operative to change the state of the torque control means in response to a change in state of an electrical input signal, whereby the rotational speed of the impeller is caused to vary between said first and second states to transmit a modulated pressure signal in the mud flow in response to input of a varying electrical input signal to the signalling means.

Thus, instead of modulating the mud pressure by throttling the mud flow as in the previously disclosed system, this system makes use of an entirely new method of modulation according to which the mud pressure is modulated by varying the rotational speed of an impeller disposed in the mud flow. Such a system possesses a number of advantages over the previous system in terms of cost, simplicity of design and reliability in operation. More particularly the fact that a linearly displaceable throttling member is not required means that it is no longer necessary to provide a seal, which is subject to wear, between such a throttling member and a casing for maintaining the control mechanism in a mudfree environment. Furthermore the fact that a flow constrictor is not required obviates any problems of erosion caused by the constricted mud flow, and additionally makes it simpler to construct the transmitter in such a manner that it can be retrieved by a wireline up the inside of the drill string. Also the transmitter no longer requires accurate positioning with respect to the constrictor.

The transmitter preferably also includes an electrical generator which is driven by the impeller. Thus, in this arrangement, the impeller serves the dual function of modulating the mud pressure and supplying the energy for generating the required electrical power. A considerable simplification in the construction of the transmitter is thereby possible.

It is also particularly advantageous if the torque control means and the signalling means are disposed in a mud-free environment within a casing, and the impeller is disposed outside the casing and is magnetically coupled to the torque control means so that driving torque may be transmitted between the impeller and the torque control means. This disposes of the need for any sort of rotating seal between the impeller and the control means which might be prone to failure down-hole. The impeller may be annular and may surround a cylindrical portion of the casing, the magnetic coupling being substantially as described in the aforementioned prior specifications.

A number of different arrangements for the torque control means are possible within the scope of this invention. The generator may itself constitute part of the torque control means, and indeed the impeller may even constitute the rotor of the generator, or alternatively the torque control means may incorporate an actuator, separate from the generator, such as that described in the applicants' U.S. Pat. No. 4,535,429, the contents of which are incorporated in the present specification by reference.

The torque control means may, for example, comprise a hydraulic circuit incorporating a pump driven by the impeller and valve means switchable by the signalling means between a first state and a second state, a greater torque being required to drive the pump when the valve means is in the first state as compared with when the valve means is in the second state. Preferably the valve means comprises a throttle valve and a switching valve connected to supply the output from the pump to the throttle valve when in the first state and to bypass the throttle valve when in the second state.

The torque control means may also comprise a driven member coupled to the impeller and braking means for braking the driven member under control of the signalling means. The braking means may, for example, be a hydraulically operable brake for frictionally engaging the driven member to reduce the rotational speed of the driven member, and hence the impeller, when the brake is actuated. The hydraulic pressure for actuating the brake may be obtained from a pump such as that described in U.S. Pat. No. 4,535,429.

Alternatively the torque control means may comprise a driven member magnetically coupled to the impeller and means for varying the magnetic coupling between the driven member and the impeller under control of the signalling means.

As a further alternative the generator may constitute part of the torque control means and the signalling means may be arranged to vary the electrical load of the generator in response to input of a varying electrical input signal so as to vary the torque required to drive the impeller. Such an arrangement may, for example, involve an electrical generator comprising a rotor and a wound stator having a first winding for supplying a measuring instrument and a second winding, and switching means connected to the second winding for varying the electrical load of the second winding in response to the output of the measuring instrument. For example, the switching means may be switchable between a first position in which it shortcircuits the second winding in order to apply a relatively high load and a second position in which it open-circuits the second winding in order to apply a relatively low load.

Although in the above description reference is made to varying the speed of the impeller between a first rotational speed and a second rotational speed, it should be understood that the impeller speed need not necessarily change abruptly between these two values so as to produce substantially square pressure pulses, but may instead vary gradually in such a manner as to produce a continuously varying pressure signal, for example a sinusoidally varying pressure signal. Moreover the speed variation may be controlled so as to frequency modulate a carrier pressure signal with the output of the measuring instrument, so as to render the transmitted data effectively independent of any variation in the amplitude of the pressure signal.

BRIEF DESCRIPTION OF THE DRAWINGS

In order that the invention may be more fully understood, a preferred form of down-hole signal transmitter in accordance with the invention will now be described, by way of example, with reference to the accompanying drawings, in which.

DETAILED DESCRIPTION OF THE DRAWINGS

Figure 1:
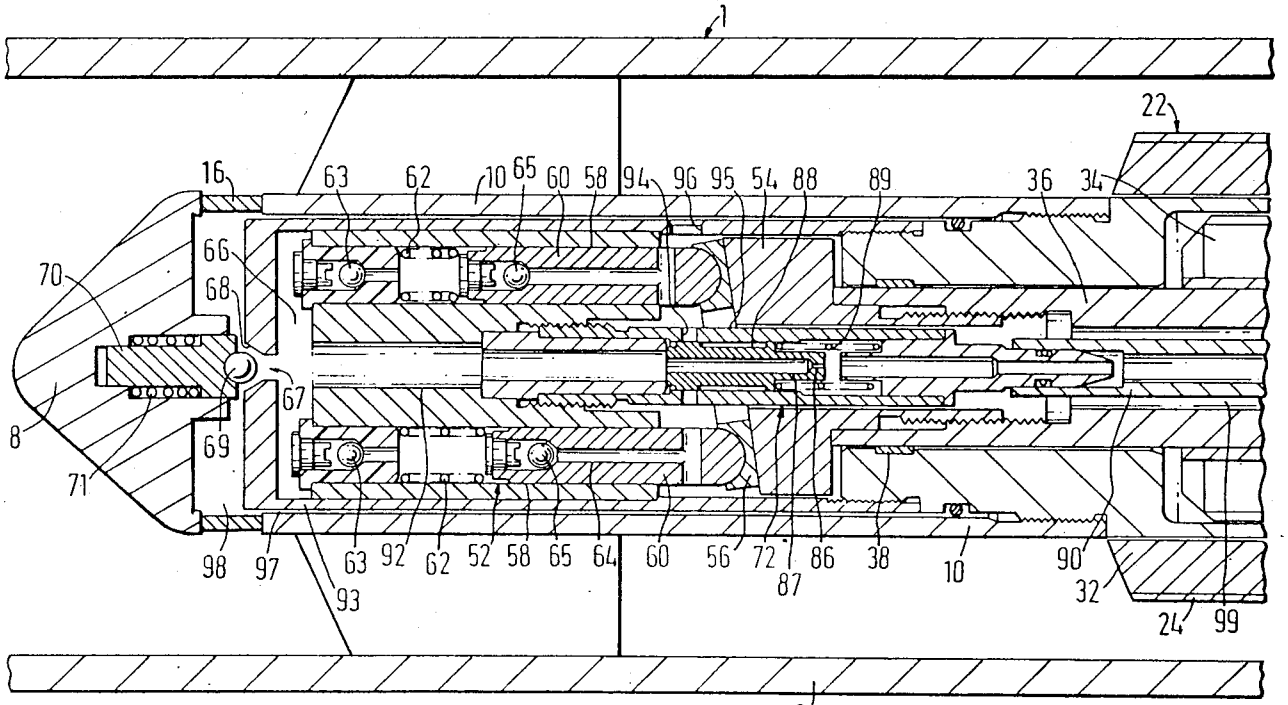
FIG. 1 is a longitudinal section through an upper part of the transmitter.

The signal transmitter 1 illustrated in the drawings is installed in use within a non-magnetic drill collar, and is coupled to a measuring instrument also installed within the drill collar, immediately below the transmitter 1. The drill collar is disposed at the end of a drill string within a borehole during drilling, and the measuring instrument may serve to monitor the inclination of the borehole in the vicinity of the drill bit during drilling, for example. The signal transmitter 1 serves to transmit the measurement data to the surface, in the form of pressure pulses, by modulating the pressure of the mud which passes down the drill string. The transmitter 1 is formed as a self-contained unit and is installed within the drill collar in such a manner that it may be retrieved in the event of instrumentation failure for example, by inserting a wireline down the drill string and engaging the wireline with a fishing neck (not shown) on the transmitter, for example by means of a per se known gripping device on the end of the wireline, and drawing the transmitter up the drill string on the end of the wireline.

Referring to FIG. 1, in which an upper part of the transmitter is shown, the transmitter 1 includes a duct 2 within which an elongate casing 10 having a streamlined nose 8 is rigidly mounted by three upper support webs 18 and three lower support webs (not shown) extending radially between the casing 10 and the duct 2, so as to provide an annular gap between the casing 10 and the duct 2 for mud flow. The space within the casing 10 is filled with hydraulic oil, and a flexible annular diaphragm 16 is provided in the wall of the casing 10 in order to ensure hydrostatic pressure balance across the casing 10.

Figure 2:
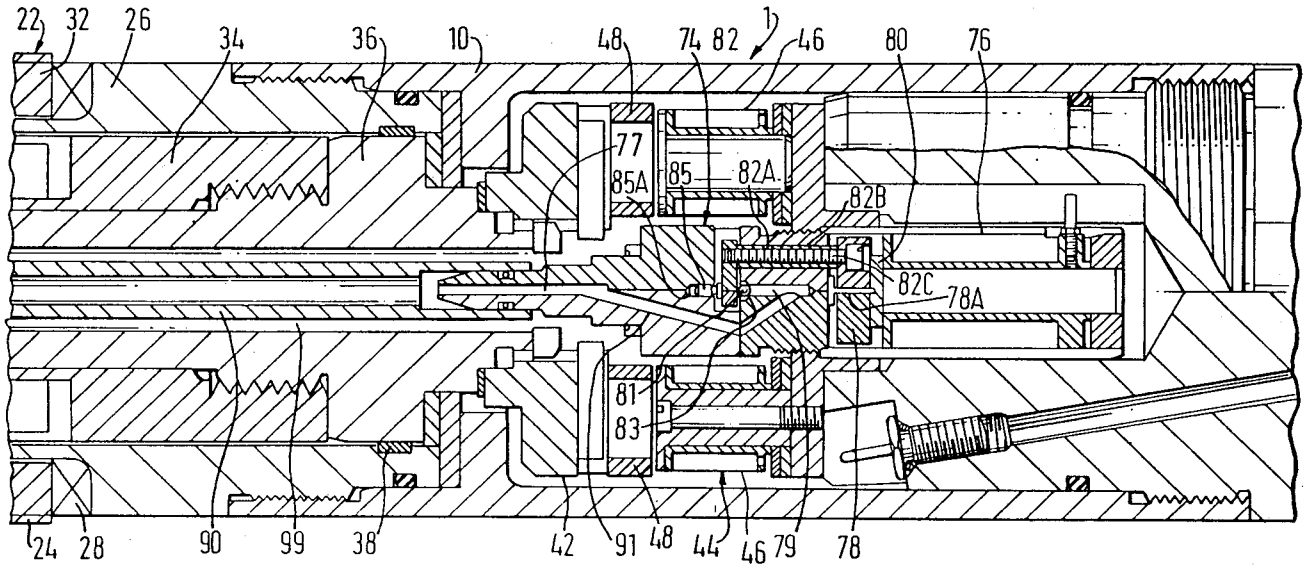
FIG. 2 is a longitudinal section through a lower part of the transmitter, with the outer duct omitted.

FIG. 2 shows a lower part of the transmitter in which the duct 2 has been omitted. It should be appreciated that the transmitter also includes a further non-illustrated part between the upper part and the lower part. An annular impeller 22 having a series of blades 24 distributed around its periphery and angled to the mud flow surrounds the casing 10, as shown in FIGS. 1 and 2, and is carried on a shoulder 26 of the casing 10 by means of a filled PTFE (polytetrafluoroethylene) thrust bearing 28. The blades 24 are mounted on a copper drive ring 32. A rare earth magnet assembly 34 is carried by an annular shaft 36 rotatably mounted within the casing 10 by means of bearings 38, and incorporates six Sm Co (samarium-cobalt) magnets distributed about the periphery of the shaft 36. Three of the magnets have their North poles facing radially outwardly and a further three of the magnets, alternating with the previous three magnets, have their South poles facing radially outwardly. As the impeller 22 rotates in the mud flow, eddy currents will be induced in the copper drive ring 32 by the intense magnetic field associated with the six Sm Co magnets, and the magnet assembly 34 and hence the shaft 36 will be caused to rotate with the impeller 32 by virtue of the interaction between the magnetic field associated with the magnets and the magnetic field associated with the eddy currents induced in the drive ring 32.

The annular shaft 36 drives a rotor 42 of an electrical generator 44 (FIG. 2) for supplying power to the measuring instrument. The generator 44 is a three-phase a.c. generator comprising a wound stator 46 having six poles equally spaced around the axis of the generator 44, and the rotor 42 incorporates eight Sm Co magnets 48 also equally spaced around the axis of the generator 44, four of the magnets 48 having their North poles facing the stator 46 and a further four of the magnets 48, alternating with the previous four magnets 48, having their South poles facing the stator 46. In addition the annular shaft 36 drives a hydraulic pump 52 (FIG. 1) of a torque control arrangement by way of an angled swashplate 54 and an associated piston thrust plate 56.

The hydraulic pump 52 comprises eight cylinders 58 extending parallel to the axis of the casing 10 and arranged in an annular configuration, and a respective piston 60 associated with each cylinder 58. The lower end of each piston 60 is permanently biased into engagement with the thrust plate 56 by a respective piston return spring 62, so that rotation of the swashplate 54 with the shaft 36 will cause the pistons 60 to axially reciprocate within their cylinders 58, the eight pistons 60 being reciprocated cyclically so that, when one of the pistons is at the top of its stroke, the diametrically opposing piston will be at the bottom of its stroke and vice versa. Each cylinder 58 is provided with a non-return valve 63 at its upper end, and each piston 60 is provided with a bore 64 incorporating a further non-return valve 65. The valve 65 opens towards the bottom of each stroke of the piston 60 to take in hydraulic oil, and the valve 63 opens towards the top of each stroke of the piston 60 to output hydraulic oil to an output chamber 66. The outputs of the cylinders 58 are supplied to the chamber 66 cyclically.

In a first state of the torque control arrangement, the output from the pump 52 may be supplied to a throttle valve 67 having a seating 68 and a ball 69 biased into engagement with the seating 68 by a guide member 70 and a spring 71, the return flow to the pump input being by way of a chamber 98, the annular space 97 between a sleeve 93 and the casing 10 and an aperture 96 in the sleeve 93. In a second state of the torque control arrangement, the output of the pump 52 is fed back directly to the input by way of a central duct 92 under control of a hydraulic amplifier which comprises a main switching valve 72 (FIG. 1) and a subsidiary control valve 74 (FIG. 2) interconnected by a duct 90. The control valve 74 is operable by a signalling actuator in the form of a solenoid 76 under control of the output of the measuring instrument.

In order to show the internal construction of the control valve 74, this valve is shown in FIG. 2 with the lower half of the valve, as seen in the drawing, sectioned along the same plane as the rest of the drawing, but with the upper half of the valve sectioned along a longitudinal plane at right angles to the aforementioned plane. Thus the valve 74 incorporates an axial conduit 77 which opens into two branch conduits 91 which are symmetrically arranged about the longitudinal axis but only one of which is visible in FIG. 2 in view of the fact that the plane along which the upper half of the valve is sectioned is at right angles to the plane in which the branch conduits 91 are disposed. The two branch conduits 91 lead into an axial blind bore 79 which is terminated by a valve seating 83 within which a valve ball 81 is seated. The ball 81 is acted upon by a generally U-shaped member 82 which incorporates a guide rod 85 extending into a guide bore 85A and two hollow arms 82A extending through bores 82B. The bores 82B are symmetrically arranged about the longitudinal axes but only one of these is visible in the drawing in view of the fact that the plane in which the bores 82B are disposed is at right angles to the plane along which the lower half of the valve 74 is sectioned. The arms 82 are connected by screws 82C to an armature 78 which is mounted on a guide pin 78A so that the armature 78 and the U-shaped member 82 are capable of limited axial movement with respect to the remainder of the valve 74.

When the form of the output signal from the measuring instrument is such as to cause the solenoid 76 to magnetically attract the armature 78, the armature 78 and the U-shaped member 82 are in the position shown in FIG. 2 with the U-shaped member 82 acting on the ball 81 to keep the valve 74 closed. When the form of the output signal from the measuring instrument changes so as to break the magnetic attraction between the armature 78 and the end plate 80 of the solenoid 76, the U-shaped member 82 is axially displaced by the action of the ball 81 of the control valve 74 being raised from its seating 83 by fluid pressure, thereby opening the control valve 74. It will be appreciated that the degree to which the ball 81 is lifted off its seating 83 is limited by the travel of the armature 78. This has the effect of enabling a small flow of oil from the pump output to the pump input, this flow passing from the duct 92 along a bore 87 through a valve member 88 of the main switching valve 72 (see FIG. 1) and through a constriction 86 within the bore 87 and to the control valve 74 by way of the duct 90, the return flow to the pump input being by way of the annular space 99 surrounding the duct 90.

The action of initiating a small flow of oil through the constrictor 86 causes the valve member 88 to be displaced downwardly against the action of a spring 89, by virtue of the pressure differential which is established across the valve 72 by the flow of oil through the constrictor 86. This results in apertures 94 in the form of spark-eroded slits in an outer sleeve 95 of the valve 72 being uncovered by the valve member 88, thus placing the duct 92 in direct fluid communication with the pump input and initiating a much larger flow of oil from the pump output to the pump input by way of the duct 92 and the apertures 94.

When the main switching valve 72 is opened the output of the pump 52 is fed back directly to the pump input by way of the duct 92 and the apertures 94 in the outer sleeve 95 of the valve 72, and the throttle valve 67 is bypassed. This means that the load on the pump 52 of the torque control arrangement is relatively small in this state, and a relatively small torque is required to be transmitted by the impeller 32 in order to drive the pump 52. Therefore the impeller 32 may be rotated relatively easily in the mud flow.

When the form of the output signal from the measuring instrument again changes in such a manner that the armature 78 is attracted to the end plate 80 of the solenoid 76, the U-shaped member 82 is axially displaced against fluid pressure so as to reseat the ball 81 of the control valve 74 within its seating 83, thus closing the control valve 74 and stopping the flow of oil through the constriction 86 in the valve member 88 of the pressure relief valve 72. This causes the valve member 88 to be displaced upwardly by the spring 89, so that the apertures 94 are again covered and the valve 72 is closed, thereby preventing feedback of oil directly from the output to the input of the pump 52. Thus the full output of the pump 52 is applied to the throttle valve 67 and the load on the pump 52 is thereby increased. Typically the pressure drop across the throttle valve 67 is 100 to 200 p.s.i. In this state a relatively large torque is required to be transmitted by the impeller 32 in order to drive the pump 52, and the impeller 32 is less easily rotated in the mud flow. The result of this is that the rotational speed at which the impeller 32 is driven by the mud flow is decreased.

It will be appreciated therefore that, if the measurement data from the measuring instrument is arranged to suitably vary the current passing through the signalling solenoid 76 so as to intermittently attract the armature 78 to the end plate 80 of the solenoid 76, the torque control arrangement will cause the impeller 32 to be driven alternately at two different rotational speeds and to thereby modulate the pressure of the mud flow upstream of the transmitter 1 in dependence on the measurement data. Thus a series of pressure pulses corresponding to the measurement data will travel upstream in the mud flow and may be sensed at the surface by a pressure transducer in the vicinity of the output of the pump generating the mud flow.

In an advantageous modification of the above described construction the impeller surrounds a portion of the casing of relatively small diameter extending upstream of the nose of the casing. The torque from the impeller is transmitted magnetically to a shaft within this narrow portion of the casing and the shaft in turn drives the pump of the torque control arrangement. Such a modification possesses the particular advantage that the impeller thrust bearing may be formed with a larger surface area than is possible in the illustrated arrangement, and thus the bearing may be made less subject to wear.

We claim:

1. A down-hole signal transmitter for a mud-pulse telemetry system, the transmitter comprising:

(a) a sealed, elongate casing adapted to be incorporated in a drill string when the transmitter is installed down-hole;

(b) an electrical generator disposed in a mud-free environment within the casing for supplying power to measuring instrumentation down-hole;

(c) a turbine having an annular impeller surrounding the casing and mounted so as to be rotatable in the mud flow passing along the drill string;

(d) a rotatable member within the casing magnetically coupled to the impeller through the wall of the casing to be driven thereby and mechanically coupled to impart driving torque to the electrical generator;

(e) torque control means within the casing coupled to the rotatable member for controlling the load applied to the impeller by the rotatable member to vary the torque required to drive the impeller between a first value corresponding to a first state of the control means and a second value corresponding to a second state of the control means, whereby, in a given mud flow, the impeller is driven by the mud flow at a first rotational speed when the control means is in the first state and at a second rotational speed when the control means is in the second state; and (f) signalling means coupled to the control means and operative to change the state of the control means between the first state and the second state in response to a change in state of an electrical input signal representative of data to be signalled to the surface, whereby the rotational speed of the impeller is caused to vary between the first and second rotational speeds to transmit a modulated pressure signal in the mud flow in response to input of a varying electrical data input signal to the signalling means and the resulting modulated pressure signal is detectable at the surface and convertible into an electrical data output signal representative of the measurement data.

2. A transmitter according to claim 1, wherein the torque control means comprises a hydraulic circuit incorporating a pump driven by the rotatable member and valve means switchable by the signalling means between a first state and a second state, a greater torque being required to drive the pump when the valve means is in the first state as compared with when the valve means is in the second state.

3. A transmitter according to claim 2, wherein the valve means comprises a throttle valve and a switching valve connected to supply the output from the pump to the throttle valve when in the first state and to bypass the throttle valve when in the second state.

4. A transmitter according to claim 2, wherein the valve means comprises a hydraulic amplifier incorporating a main, switching valve and a subsidiary, control valve for controlling a main flow of fluid from the pump through the main valve by acting on a subsidiary flow of fluid of relatively low magnitude.

5. A transmitter according to claim 1, wherein the signalling means is a solenoid-operated actuator.

6. A transmitter according to claim 1, wherein the torque control means comprises means for varying the electrical load of the generator in response to input of a varying electrical input signal to the signalling means so as to vary the torque required to drive the impeller.

7. A transmitter according to claim 1, wherein the torque control means comprises means for varying the magnetic coupling between the rotatable member and the impeller under control of the signalling means.

8. A transmitter according to claim 1, wherein the torque control means comprises braking means for braking the rotatable member under control of the signalling means.

* * * * *